United States Patent [19]

Norman et al.

[11] 4,109,666

[45] Aug. 29, 1978

[54] CIGARETTE FILTER

[75] Inventors: Vello Norman, Raleigh; Charles M. Moogalian, Durham, both of N.C.

[73] Assignee: Ligett Group Inc., Durham, N.C.

[21] Appl. No.: 662,624

[22] Filed: Mar. 1, 1976

[51] Int. Cl.[2] ..... A24D 1/04

[52] U.S. Cl. ..... 131/261 B; 131/10.3; 93/1 C

[58] Field of Search ..... 131/9, 10 R, 10 A, 10.3, 131/10.5, 10.7, 10.9, 11, 261 R, 261 B, 264, 265, 266, 268; 93/1 C

[56] References Cited

U.S. PATENT DOCUMENTS

| | | | |
|---|---|---|---|
| 3,270,750 | 9/1966 | Campbell | 131/10.7 |
| 3,347,245 | 10/1967 | Hawkins | 131/10.5 |
| 3,389,705 | 6/1968 | Levavi | 131/10 A |
| 3,752,165 | 8/1973 | Harlee | 131/10.5 |
| 3,860,011 | 1/1975 | Norman | 131/10.5 |

*Primary Examiner*—Robert W. Michell
*Assistant Examiner*—V. Millin
*Attorney, Agent, or Firm*—J. Bowen Ross, Jr.; Michael L. Hendershot

[57] ABSTRACT

A filter tipped cigarette includes a cylindrical tobacco section and a cylindrical filter axially aligned therewith. The filter is comprised of an axially aligned tube extending from said tobacco section, a layer of filter material positioned circumferentially about said tube and a diffuser adjacent an end of the tube for dispersing the smoke received from the tube prior to entering the smoker's mouth.

1 Claim, 7 Drawing Figures

CIGARETTE FILTER

This invention relates to a cigarette filter. More particularly, this invention relates to a cigarette filter having an axially aligned hollow tube communicating the tobacco column with a smoke diffuser.

Heretofore, various types of filters have been devised for use in cigarettes in order to screen out certain filterable materials which comprise the tobacco smoke screen. For example, filters made up of fibrous materials, such as a cellulose acetate, have been known for filtering out particulate matter from the smoke generated during smoking. However, such a filtering medium between a smoker's mouth and the tobacco column of the cigarette generally require an additional drawing or inhaling force on the part of the smoker in order to draw the smoke through the filtering material. As a result, a practical limit has been imposed on the amount of particulate matter that can be filtered out by a particular filtering material due to the need to have a pressure drop across a filter that can be tolerated by a smoker without discomfort.

In more recent times, attempts have been made to dilute the smoke stream from a cigarette with ventilating air to reduce the quantity of particulate matter drawn into a smoker's mouth for each puff while allowing the taste to pass through. Some of these attempts have used bypass arrangements by which a greater or lesser proportion of the cigarette smoke can be bypassed around a filter medium and drawn into a smoker's mouth. In some cases, the filters have been provided with passageways through which a portion of unfiltered smoke can be passed directly to the smoker's mouth, for example, as in U.S. Pat. No. 3,860,011. Such passageways have usually been provided directly in the filter material and the filter material has been constructed so as to be collapsed manually about the passageway to constrict the size of the passageway and, thus, reduce the proportion of unfiltered smoke passing through to a smoker, for example, as described in U.S. Pat. Nos. 3,242,925 and 3,270,750.

One of the reasons for utilizing filters with bypass passages is that the flow of unfiltered smoke can be drawn through the filter at a greater speed than the filtered flow which passes through the filtered material so that the faster flow can impinge upon the tongue and taste buds of the smoker at a greater impact speed than the normal. This is believed to impart a greater taste to the smoke. However, such direct impingement upon the tongue can be irritating especially during the next-to-last and last puff when the burning tobacco is proximate the filter tip and the smoke is hot.

Accordingly, it is an object of the invention to provide a filter having a centered smoke bypass passage partially extending the length of the filter and having a diffuser positioned on the smoker's end of the cigarette to disperse the unfiltered smoke prior to being drawn into the smoker's mouth.

It is another object of the invention to provide an apparatus and process for placing a hollow tube in a cellulose acetate filament filter such that the filaments disperse the smoke exiting the tube.

Briefly, the invention provides a filter for a cigarette which allows a portion of substantially unfiltered but dispersed smoke to enter a smoker's mouth at high velocity while diluting the smoke with drawn-in air in the mouth.

The filter is used in combination with a cigarette tobacco section and is joined to the tobacco section by a cylinder or outer wrap of tipping paper. The filter is constructed of a preferably rigid tube, a layer of compacted filter material and a cylinder of perforated or inherently porous plugwrap paper. The tube defines a smoke passage of constant cross-sectional area throughout having a draw resistance for controlling the amount of unfiltered smoke delivered to a diffuser prior to entry into a smoker's mouth. The diffuser does little to filter the smoke and acts to disperse the smoke as previously mentioned. The layer of filter material surrounding the tube and forming the diffuser preferably is continuous filament cellulose acetate. The plugwrap paper is porous like tea bag paper. The tipping paper which connects the filter to the tobacco column is provided with a plurality of perforations, the number and size of which define the quantity of air to be mixed with the filtered smoke and the substantially unfiltered smoke and draw resistance. The draw resistance through the perforations and filter complement the draw resistance of the smoke through the tube and diffuser whereby for a given draw a desired amount of substantially unfiltered smoke and ventilation air are drawn into the smoker's mouth.

The means for enveloping the fibrous material about the tube feeding mandrel and the forming means can be of known construction, as is conventionally used in forming filter rods of fibrous filter material of solid construction. For example, this means can be in the form of a nozzle having a Venturi-opening and an air supply as described in British Pat. No. 933,827.

The tube is continuously drawn from a supply and is cut into predetermined lengths prior to being advanced to the mandrel. The mandrel is provided with an internal feed for selectively delivering the cut lengths of rods to the fibrous material.

These and other objects and advantages of the invention will become more apparent from the following detailed description and appended claims taken in conjunction with the accompanying drawings in which:

Figure 1:
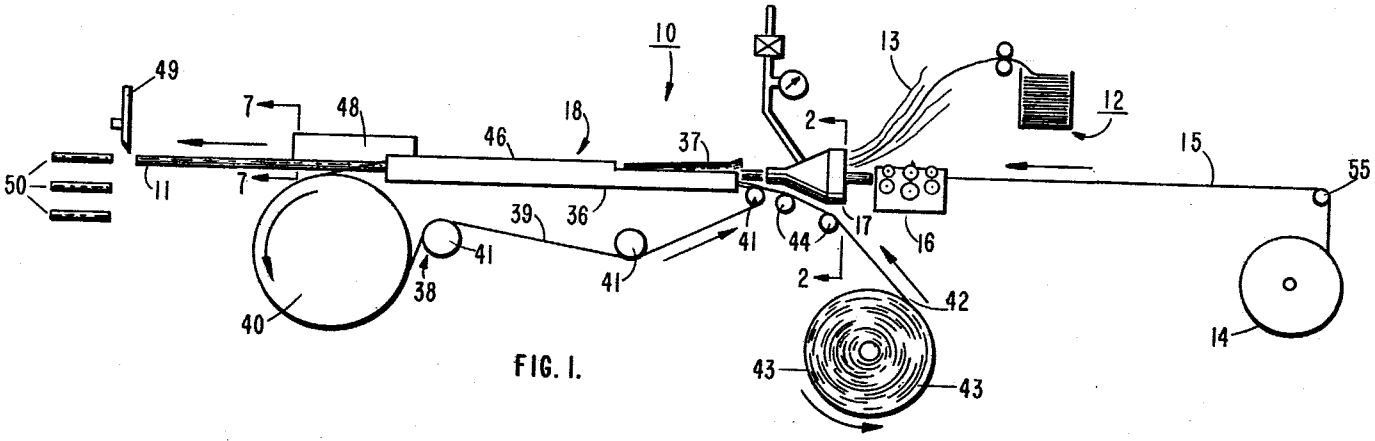
FIG. 1 illustrates a schematic view of an apparatus for making the hollow filter rod with diffuser according to the invention.
Figure 4:
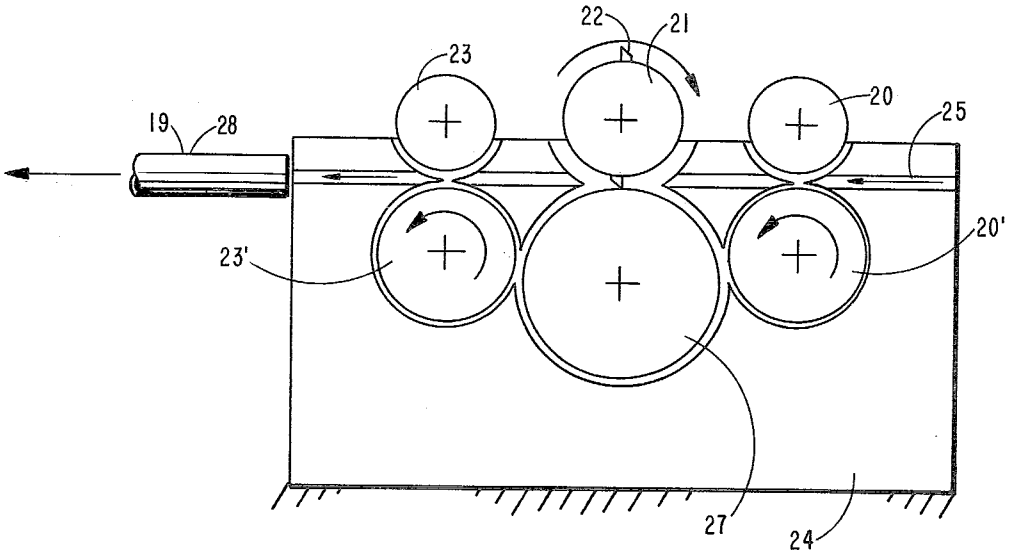
FIG. 4 is an elevation view of the rod cutting mechanism.

Referring to FIG. 1, the apparatus 10 for making a hollow cigarette filter with diffuser 11 includes a means 12 for supplying a stream of fibrous filter material 13 such as a cellulose acetate tow and a means such as a supply reel 14 for supplying a stream of tubing 15, for example, of hollow plastic material. The apparatus 10 includes a tube cutting means 16 receiving tubing 15 and severing same into predetermined lengths, a means 17 for shaping the stream of fibrous filter material 13 about the tubing 15 and a rod former 18 of conventional construction for wrapping the streams of filter material and tubing into the filter rod 11. Referring to FIGS. 1 and 4, tube cutter 16 is positioned downstream of the supply reel 14 and includes opposed draw rollers 20 and 20', cutting roller 21 having cutting blades 22 and opposed feed rollers 23 and 23', these rollers being supported by housing 24. Tubing 15 is drawn along passageway 25 by draw rollers 20 and 20' by the frictional engagement of peripheries of the rollers against the tubing. Cutting roller which rotates in timed sequence with rollers 20 and 20' then sever tubing 15 in to short predetermined sections 26. Cutting roller 21 acts against free wheeling anvil roller 27. Tubing sections 26 are then forwarded along passageway 25 into nozzle 32 through connecting rod 19. Connecting rod 19 includes a leaf spring 29 which acts as a drag against short tube sections 26.

Figure 2:
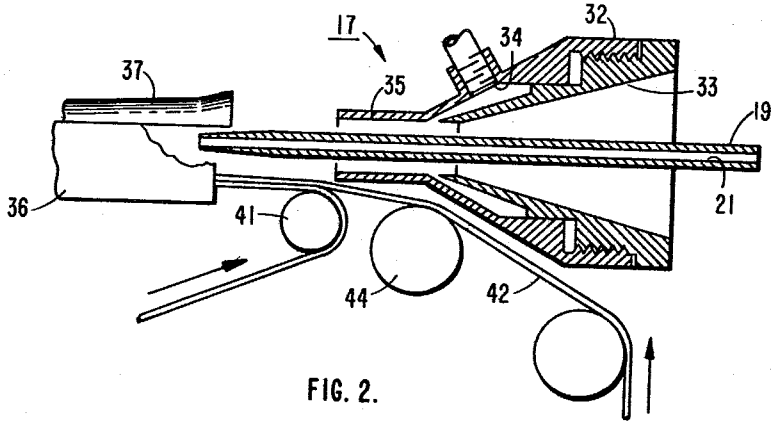
FIG. 2 illustrates an enlarged partly cross-sectional view of the apparatus of FIG. 1.

Referring to FIG. 2, the means 17 for shaping the stream of filter material 13 about the tubing 15 includes a nozzle 32 which is similar to that described in British Pat. No. 933,827. That is, the nozzle 32 includes an internal bore 33 of Venturi-shaped configuration, an annular air chamber 34 which receives air from a suitable air supply source (FIG. 1) and surrounds the Venturi-shaped bore 33, and a Venturi-opening 35 communicating the chamber 34. The entrance end of the nozzle bore 33 is sized to receive the stream of filter material 13 with the material in a spread and decrimped manner from the filter material supply 12.

The rod former 18 is constructed with a forming block 36 and a tongue 37 mounted on the topside of the block 36. The block 36 and tongue 37 form a passageway (not shown) into which the connecting rod 28 projects. This latter passageway is sized to receive the tubing 15 passing through the connecting rod 28 and the fibrous filter material 13. The tongue 37 and the forming block 36 are also tapered internally to form an inwardly tapering surface for the passageway so that the passageway gradually diminishes in cross-section. In addition, the rod former 18 includes a conveyor 38 having a conveyor belt 39, such as a continuous fabric belt, which is driven by a belt drive wheel 40 over guide rolls 41 through the passageway formed by the block 36 and tongue 37. The belt 39 is used to move a stream of porous web 42 e.g. plugwrap paper from a suitable supply reel 43 into the passageway via guide rollers 44 as well as to convey the filter material 13 and tubing stream 15. The web 42 is inherently porous for purposes as explained below.

Figure 7:
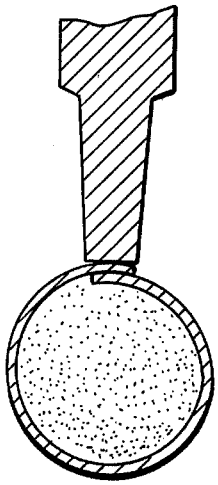
FIG. 7 is a cross-section taken along lines 7-7 of FIG. 1 and showing an anvil heat sealing the plugwrap paper.

As shown in FIG. 1, the rod former 18 includes a pair of folding sections 46 as are known and heat sealer 48. The folding sections 46 serve to fold the edges of the delivered web 42 towards each other in enveloping relationship to the filter material and the tubing while heat sealer 48 heat web 42. Web 42 is impregnated with a thermoplastic material, such as a polyvinyl acetate/-polyvinyl chloride copolymer. Upon heating, the copolymer from overlapping web fuses and upon cooling forms a seam. Note FIG. 7, a cross-section taken along lines 7—7 of FIG. 1, which illustrates an anvil heat sealing the plugurap paper.

Figure 3:
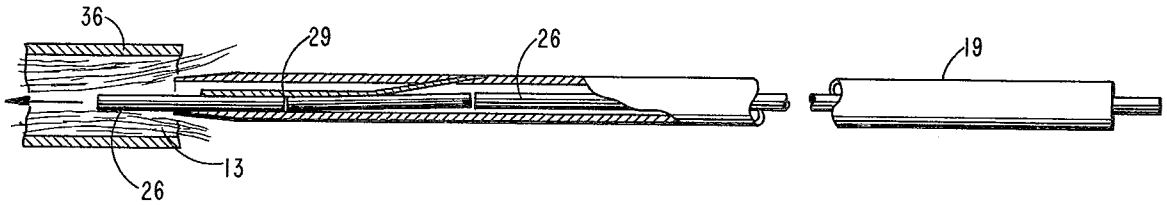
FIG. 3 illustrates a perspective view of the portion of the mandrel showing the drag working against a length of rod.
Figure 6:
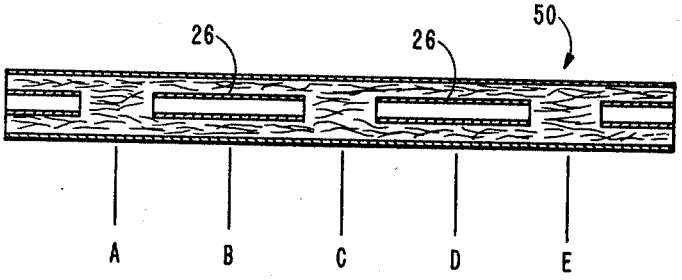
FIG. 6 is a cross-section of a cut length of filter showing the hollow tube sections axially aligned and sequentially spaced along the length of the filter rod.
Figure 7:
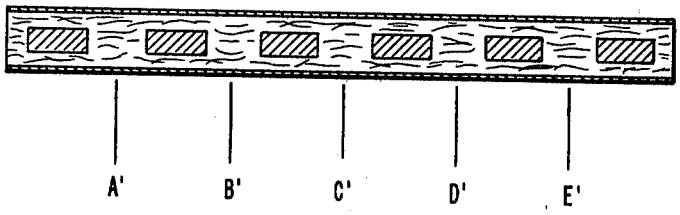
Figure 8:
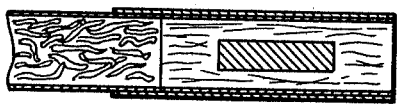

As shown in FIG. 3, fibrous filter material 13 is being constricted by the walls of block 36 to the extent that friction is developed between tubing sections 26 and filter material 13. With a known speed of filter material 13 through block 36, feed rollers 23 and 23' advance tubing sections 26 at a slower rate such that tubing sections 26 are spaced at predetermined intervals along the length of filter rod 50 as shown in FIG. 6.

A suitable cutting mechanism utilizing a knife 49 is disposed downstream of the sealer 48, as is known, for cutting the completed filter rod 11 into predetermined lengths 50. Each length may thereafter be cut into a multiplicity of filters.

Referring to FIG. 1, in operation, a stream of filter material 13 is fed from the supply source 12, in spread out and decrimped in a conventional fashion as is known and delivered into the nozzle 32. In addition, a length of tubing 15 is taken from the supply reel 14 and passed through cutter 16 into the mandrel 19. After the filter material stream 13 is passed into the nozzle 32, the air which is supplied to the nozzle 32 causes the material to bloom, for example, as described in U.S. Pat. No. 3,367,447. This allows the fibrous material to be evenly distributed around the tube and to be pushed along the surface of the mandrel 19 into the rod former 18 rather than pulled. Thereafter, as the filter material 13 is passed into the rod former 18 between the folding block 36 and the tongue 37, the fibrous material is gradually reduced circumferentially due to a tapering of the tongue 37 relative to the forming block 36. The filter material 13 is then brought into direct contact with the tubing 15, which has been severed into lengths by cutter 16, within the rod former 18 and is juxtaposed in enveloping circumferential relationship with the tubing 15. At the same time, the web of paper 42 is guided into the rod former 18 underneath the tubing 15 and filter material 13 and folded into a generally U-shape. Continued travel of the tubing and filter material causes the filter material to be constricted circumferentially about the tubing 15 and to hold the tube lengths 26 in place at spaced intervals along its axial length.

The movement of the fibrous material 13 through the rod former 18 is facilitated by the conveyor belt 37 and the paper web 42 as is known. In addition, the paper web 42 is subsequently folded about the constricted filter material 13 and the engaged tubing 15 with the paper edges sealed together to form a filter rod 11 of continuous length. The filter rod 11 is then severed into predetermined lengths 50 by the knife 49.

Knife 49 is programmed to sever filter rod 11 midway between the ends of a selected tube section 26. The embodiment shown in FIG. 6 prepares filter rod 50 to be severed along the liner identified by A, B, C, D and E in the cigarette making machine. Thus, six cigarette filters are made from one filter rod 5 and each is joined to a tobacco column T to form a filter cigarette as shown in FIG. 5.

Figure 5:
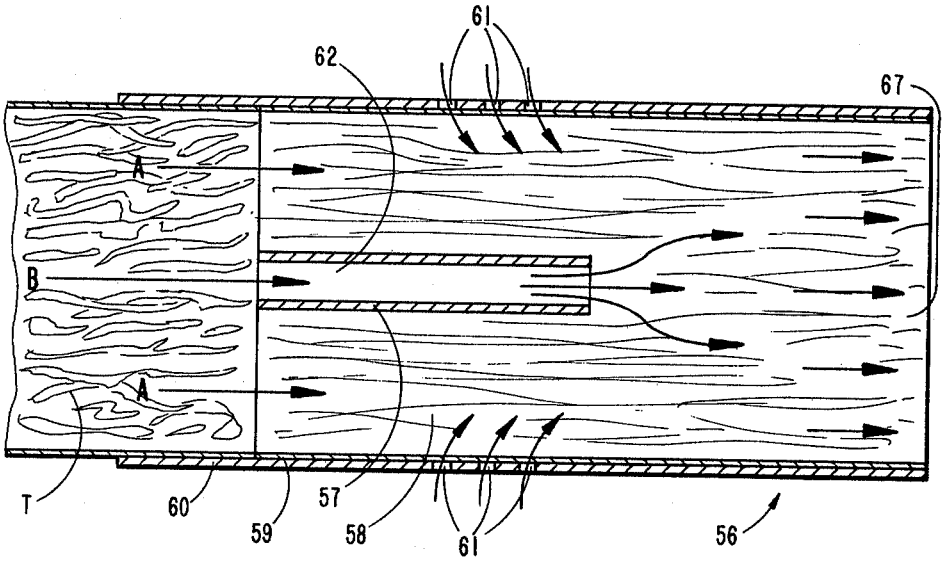
FIG. 5 illustrates a cross-sectional view of a cigarette having a filter made in accordance with the invention.

Referring to FIG. 5, a filter 56 formed from the filter rod 11 includes a hollow cylindrical tube 57 surrounded by an annular layer of compacted filter material 58, a wrapping of perforated mouthpiece paper 59 and an outer wrap of tipping paper 60. The filter 56 is mounted, as is known, by means of the outer wrap of tipping paper 60 on a tobacco column T to form a cigarette. The outer wrap of mouthpiece paper 60 is provided with a number of circumferential rows of perforations 61 which are located at about the mid-section of the filter 56.

As shown in FIG. 5, the tube 57 is centered on the axis of the filter 56 and forms a passageway 62 from the tobacco column T to diffuser 67.

The smoke (see arrows in FIG. 5 for smoke and air path) generated in the burning cigarette cone during the puff upon reaching the filter 56 travels predominantly through the unencumbered passageway 62 in the tubing 57. Upon reaching diffuser 67, the smoke is scattered somewhat but will not be diluted by the air entering through perforations 61 which has diluted the already much filtered smoke which has traveled the full length as indicated by arrow A. Arrow B shows a larger quantity of smoke entering passageway 62. Even though the quantity of this smoke is reduced when compared to normal filter cigarettes, its substantially unfiltered and undiluted state will have the effect of enhancing the taste of the cigarette to the smoker.

The other part of the smoker's puff volume brings in air from the surrounding environment via the perforations 61 in the tipping paper, through the plugwrap paper 59 and the filter material 58 into the smoker's mouth. The air does not mingle with smoke until it is delivered into the smoker 's mouth. This enhances the possibility of the smoker getting an increased flavor impression from the delivered smoke stream. In conventional cigarettes utilizing perforated tipping, diluting air and smoke mix within the filter with the delivered smoke stream being prediluted before impinging in the smoker's mouth.

What is claimed is:

1. A cylindrical article comprising a plurality of tubes of equal length being axially aligned and spaced apart given and equal distances along said axis, a layer of compacted filter material positioned circumferentially about said tubes and extending the length of said cylindrical article, said filter material frictionally holding said tubes in position along said axis and said filter material being compacted to a state of greater density in the area surrounding said tubes and to a state of lesser density in the area extending between said tubes and a cylinder of plug wrap material about said layer of filter material for maintaining said filter material in its relative density states.

* * * * *